US010966289B2

(12) United States Patent
Schmider et al.

(10) Patent No.: US 10,966,289 B2
(45) Date of Patent: Mar. 30, 2021

(54) HEATING DEVICE WITH HIGH TEMPERATURE-DEPENDENT ELECTRICAL RESISTANCE GRADIENT OF THE HEATING WIRES

(71) Applicant: WWT Technischer Gerätebau GmbH, Stuttgart (DE)

(72) Inventors: Klaus Schmider, Stuttgart (DE); Wolfgang Theilacker-Beck, Stuttgart (DE); Matthias Theilacker, Hopfauerstr (DE)

(73) Assignee: STIHLER ELECTRONIC GMBH, Stuttgart (DE)

( * ) Notice: Subject to any disclaimer, the term of this patent is extended or adjusted under 35 U.S.C. 154(b) by 155 days.

(21) Appl. No.: 16/181,716

(22) Filed: Nov. 6, 2018

(65) Prior Publication Data

US 2019/0075618 A1 Mar. 7, 2019
US 2020/0107409 A9 Apr. 2, 2020

(30) Foreign Application Priority Data

Nov. 7, 2017 (DE) ..... 20 2017 106 715.7

(51) Int. Cl.
*H05B 1/02* (2006.01)
*H05B 3/54* (2006.01)
*H05B 3/12* (2006.01)

(52) U.S. Cl.
CPC ..... *H05B 3/54* (2013.01); *H05B 3/12* (2013.01)

(58) Field of Classification Search
CPC ... H05B 1/02; H05B 3/54; H05B 3/12; H05B 1/025; H05B 3/0085
USPC ..... 219/505, 504, 494, 212
See application file for complete search history.

(56) References Cited

U.S. PATENT DOCUMENTS 4,523,086 A * 6/1985 Eilentropp ..... H05B 3/58 219/549
4,655,857 A * 4/1987 Masumoto ..... C22C 19/058 148/423
5,091,631 A * 2/1992 Dupuis ..... F23Q 7/001 219/270
8,288,693 B2 * 10/2012 Weiss ..... H05B 3/84 219/541
2017/0071030 A1 * 3/2017 Schlipf ..... H05B 3/48

FOREIGN PATENT DOCUMENTS

DE 10 2006 032 775 B4 1/2008
DE 10 2011 004 481 A1 8/2012
DE 20 2017 102 578 U1 9/2018

* cited by examiner

*Primary Examiner* — Mark H Paschall
(74) *Attorney, Agent, or Firm* — Hackler Daghighian Martino & Novak

(57) ABSTRACT

A heating device for a medical instrument is disclosed. The heating device includes a heating wire. The heating wire is of a metal alloy that has in the temperature range between 0° C. and 100° C. a temperature-sensitive electrical resistance gradient of at least 0.004 Ω/(m*K).

11 Claims, 4 Drawing Sheets

SdT-Prior Art

SdT-Prior Art

SdT-Prior Art

HEATING DEVICE WITH HIGH TEMPERATURE-DEPENDENT ELECTRICAL RESISTANCE GRADIENT OF THE HEATING WIRES

CROSS-REFERENCE TO RELATED APPLICATIONS

This application claims priority to German Patent Application No. 20 2017 106 715.7, filed Nov. 11, 2017, the entire contents of which are hereby incorporated in full by this reference.

DESCRIPTION

Field of the Invention

The invention relates to a heating device for a medical instrument as well as a medical device with such a heating device.

Background of the Invention

It is known to provide heating devices to warm a patient or to heat medical liquids such as blood, infusions, or the like. It is furthermore known to provide temperature sensors to monitor the temperature of the heating device, both to avoid temperatures that are too low or too high. In particular excessive heating should be avoided, because in the medical area, media are often heated that are sensitive to high temperatures and that degrade under excessive temperatures.

Improper handling of the heating device may, however, cause the temperature of the medical instrument to be heated to significantly deviate in some areas (locally) from the temperature measured by the heating device, for example when the heating profile only has partial contact with the medical instrument, which causes a lower increase in temperature at this location, or if an additional item such as a pillow and/or the patient himself partially covers the medical instrument and therefore performs a local insulating effect, which leads to higher temperatures at that location. If, for example, the heating device has no thermal contact with the liquid to be heated in the medical instrument in the area where the temperature is measured, the temperature of the heating device would still be controlled based on the temperature in the area where the temperature is measured, which would cause the liquid outside of the area where the temperature is measured to overheat.

A larger section of the heating device can be monitored with a higher number of temperature sensors. This would, however, be more difficult to manage and to regulate, and also significantly more expensive to produce. Still, however, local overheating, which could occur for example when the heating wire is damaged due to high transition resistances, could be overlooked.

Task of the Invention

It is therefore the task of the present invention to provide a heating device that is protected against local overheating.

Another task of the present invention is to provide a medical device with such a heating device.

SUMMARY OF THE INVENTION

Description of the Invention

According to the invention, this task is solved by a heating device according to claim 1 and a medical device according to claim 6. The subclaims describe preferred further developments.

The task according to the invention is therefore solved by a heating device with a heating wire, whereby the electrical resistance of the heating wire increases, as the temperature increases in a range between 0° C. and 100° C., with a gradient of at least 0.004Ω/(m*K), in particular of at least 0.008Ω/(m*K), preferably of at least 0.01Ω/(m*K). The electrical resistance increases preferably in a substantially linear manner, in particular in a precisely linear manner. A positive gradient is provided because the increase of the electrical resistance delimits the current flow and therefore the heat output as the temperature increases and the voltage on the heating wire remains the same. The amount of the gradient must, however, be high enough so that a temperature change results in a significant current delimitation. This avoids local overheating. In addition, the measurement of the electrical resistance allows for conclusions about any potential damage to the heating wire. The termination of the temperature by means of the electrical resistance of the heating wire can make the use of other temperature sensors unnecessary, but, in most cases, it is recommendable to provide at least one additional temperature sensor.

Materials that are generally used as heating wires have an electrical resistance that is as constant as possible as the temperature rises. These materials are therefore not suitable for drawing conclusions about the temperature on the basis of the electrical resistance and/or the flow of current. Consequently, the heating wire according to the invention is preferably produced from a nickel alloy, in particular with a nickel percentage of at least or exactly 99.2%, 99.4%, 99.6%, 99.98%, and even more preferably from a nickel alloy with a nickel percentage of at least or exactly 99.6%, which comprises the required increase of the electrical resistance as the temperature rises.

To achieve a redundancy of the power supply, the heating wire preferably comprises a first heating wire strand and a second heating wire strand. If one of the two heating wire strands is damaged, this does not immediately cause the heating device to fail. Furthermore, the design using heating wire strands increases the flexibility of the heating wire. The heating wire may comprise further heating wire strands.

The heating device may comprise a heating conductor. The heating conductor provides a core for the mechanical guidance of the heating wire, whereby the heating wire is wound around the core.

The core may comprise an aramid-containing material and may, in particular, be formed from an aramid-containing material. The aramid-containing material may be present in the form of poly(p-phenylene-terephthalamide) (PPTA).

The heating conductor may comprise a heating conductor coating. The heating conductor coating may cover the heating wire and/or the core. The heating wire coating may comprise silicone, polyurethane polyvinyl chloride, fluoride-containing polymer, and/or imide-containing polymer.

The coating for the protection of the heating wire may, directly or indirectly, be applied on the heating wire and/or, directly or indirectly, on the heating conductor.

The coating is preferably arranged in the form of a cylinder barrel around the heating wire, either directly or indirectly.

The task is furthermore solved by a medical device with a previously described heating device and a heating profile, whereby the heating profile comprises a first recessed passage (through bore) that extends parallel to the central longitudinal axis of the heating profile, in which at least a section of the heating wire is arranged. The heating wire therefore extends preferably axially in the heating profile.

The heating profile may comprise a second recessed passage (through bore) in which a temperature sensor is arranged. Preferably, the temperature sensor is arranged close to the lengthwise end of the heating profile, where the highest temperature of the medium to be heated is expected. The temperature sensor facilitates a precise registration of the temperature at the inserted position. Under normal operation, this temperature is above the temperature determined from the electrical resistance of the heating wire because the latter corresponds to an average across the entire heating wire. If an electrical resistance of the heating wire is measured that indicates a higher temperature than at the temperature sensor, this may be caused by damage and a corresponding resistance increase of the heating wire or by increased heating due to insulation in an area that is not measured by the temperature sensor.

The use of a second temperature sensor is redundant and therefore increases the reliability. The second temperature sensor is preferably located and arranged in the second recessed passage close to the first temperature sensor. In addition to increasing reliability, this also increases the analysis capabilities since, among other things, a temperature gradient across a particular segment of the heating device is determined.

The heating wire may be arranged in the heating profile, at least in parts, in the shape of a U. Here, the heating profile comprises a first recessed passage that extends parallel to the central longitudinal axis of the heating profile, in which at least a section of the heating wire is arranged.

The heater profile may be created by co-extrusion together with the heating wire and/or the heating conductor.

The heating wire or the heating conduction may be inserted in a recessed passage of the heating profile after the heating profile has been cut to length.

The heating device may comprise insulating coating from a heat-insulating material at the heating profile. Alternatively, or additionally, the heating device may comprise a reinforcement strand in the heating profile.

In another preferred embodiment of the invention, the medical device comprises a medical instrument arranged on the heating device. The medical instrument may be designed in the form of an infusion tube. The medical instrument may, at least in part, be accommodated in the heating profile and, in particular, clamped into the heating profile.

As part of the medical device or as a separate component, an electrical circuit may be provided that measures the temperature and/or the electrical resistance of the heating wire. The electrical circuit may be formed to control or regulate the electrical voltage applied to the heating wire. Preferably, the electrical circuit may perform an automatic regulation of the heating wire voltage on the basis of the measurement values. It may be provided that the electrical circuit regulates the temperature to a desired value and performs a safety shutdown if the temperature is too high. It may furthermore be provided that the electrical circuit detects abnormal behavior of the heating device and displays this on a user interface.

The medical device may be designed to interrupt the current that flows through the heating wire, in particular, if the average heating wire temperature that is determined from the electrical resistance of the heating wire and/or from the current that flows through the heating wire exceeds the temperature measured by at least one temperature sensor.

The invention furthermore relates to a method for operating a medical device, in particular in the form of a medical device described and/or claimed here. The method may include the following steps:

Temperature measurement by a temperature sensor and determination of an average temperature of the heating wire from the average electrical resistance of the heating wire and/or from the current that flows through the heating wire;

Comparison of the temperature measured by the temperature sensor with the average temperature of the heating wire that was determined.

The method is able to detect abnormal behavior by the heating device when the temperature measured by the temperature sensor deviates from the average temperature of the heating wire by a preset, in particular maximum, permissible value. This abnormal behavior may be displayed on a user interface in a method step C). Alternatively, or additionally, the current that flows through the heating wire may be interrupted in step C).

Further features and advantages of the invention are provided by the description and the drawing. According to the invention, the features described above and below may be used individually or in any of a plurality of combinations. The embodiments shown and described should not be considered a definitive list, but are schematically shown and have an exemplary character for the description of the invention. The feature combinations described as prior art are based only on the assumption that they are prior art. In fact, however, they may only constitute the applicant's internal know-how.

DETAILED DESCRIPTION OF THE PREFERRED EMBODIMENTS

Figure 1A:
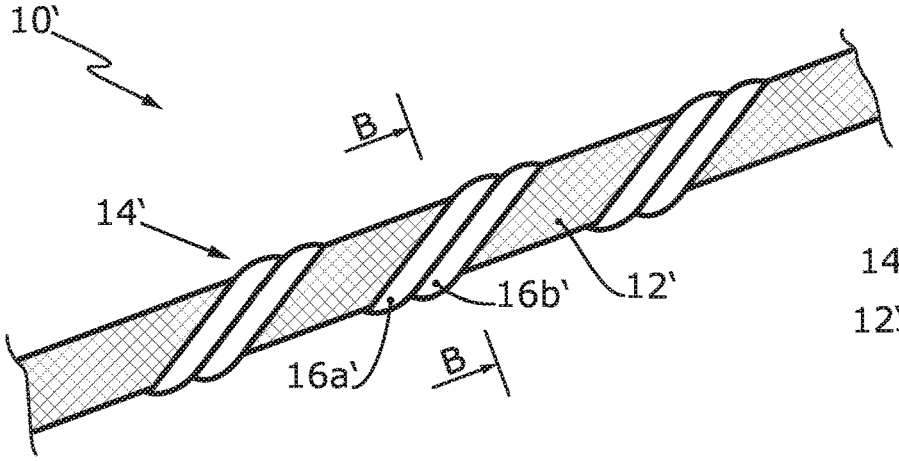
FIG. 1*a* shows an isometric partial view of a heater conductor according to prior art.

FIG. 1*a* shows a heating conductor 10' with a core 12' and a heating wire 14'. The heating wire 14' is wound around the core 12' in the form of a thread. The heating wire 14' comprises a first heating wire strand 16*a*' and a second heating wire strand 16*b*'.

Figure 1B:
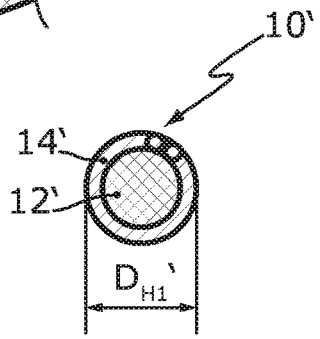
FIG. 1*b* shows a sectional view of the heater conductor from prior art according to line B-B in FIG. 1*a*.

FIG. 1*b* shows the heating conductor 10', whereby FIG. 1*b* shows that the heating wire 14' radially surrounds the core 12'. The heating conductor 10' has a diameter $D_{H1}$' of 0.9 mm±0.2 mm.

Figure 2:
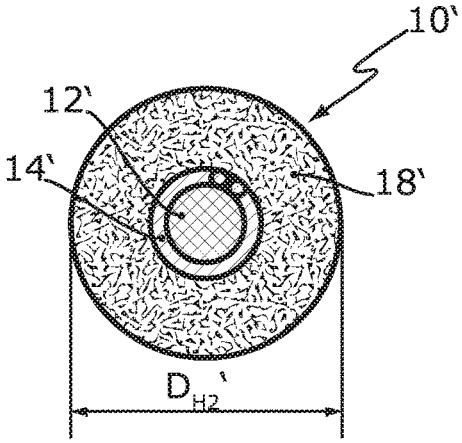
FIG. 2 shows a sectional view of another heater conductor from prior art that corresponds to FIG. 1*b*, but also comprises heater conductor coating.

FIG. 2 shows a heating conductor 10' that corresponds to the heating conductor 10' according to FIGS. 1*a* and 1*b*, whereby the heating conductor 10' comprises heating conductor coating 18' that radially surrounds the core 12' and the heating wire 14'. The heating conductor 10' according to FIG. 2 has a diameter $D_{H2}$' of 2.1 mm±0.2 mm. The heating conductor coating 18' consists of silicone or the like. Such heating conductor coating 18' is very flexible, but only insufficiently protects the heating wire 14' against strongly corrosive disinfectants.

Figure 3:
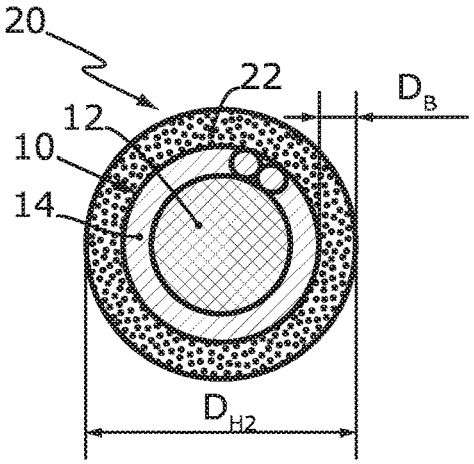
FIG. 3 shows a sectional view of a heating device.

FIG. 3 shows a heating device 20. The heating device 20 comprises a heating conductor 10 with a core 12 and a heating wire 14.

The heating wire is made from nickel alloy, in particular with a nickel percentage of 99.6%. The nickel alloy has a specific electrical resistance of 8 μΩ*cm at 20° C. and 12 μΩ*cm at 100° C. At a constant supply voltage and increasing temperature of the heating wire 14, the current is reduced due to the increasing electrical resistance, thus preventing overheating.

The steep gradient also makes it possible to determine the average temperature of the heating wire 14 by means of the electrical resistance.

The heating conductor 10 is surrounded by a coating 22 in the form of a cylinder barrel.

The coating 22 consists of a polymer containing fluoride and/or imide, which makes it resistant against strongly corrosive disinfectants.

The coating 22 has a thickness or strength $D_B$ of less than 0.5 mm. Preferably, the thickness $D_B$ ranges between 0.05 mm and 0.15 mm. This way, the coating 22 is not rigid and the overall heating device 20 is flexible.

The diameter $D_{H2}$ of the heating device 20 is 2.1 mm±0.2 mm. Considering FIG. 2 and FIG. 3 together, it becomes clear that the diameter $D_{H2}$ or respectively $D_{H2}$' of the heating device 20 or respectively the heating conductor 10' is not changed by the new coating 22. Due to the low thickness $D_B$ of the coating 22 compared to the thick heating conductor coating 18', the heating conductor 10 may have a significantly greater diameter. Hereby, the core 12 and/or the heating wire 14 may have a greater diameter and therefore significantly decrease the likelihood of the heating device 20 to fail or, respectively, increase the performance of the heating device 20 without increasing the diameter $D_{H2}$ of the heating device 20.

The heating device 20 therefore has a multiple synergy effect that does not exist in prior art since it is flexible, chemically resistant, and more fail-proof and/or higher performing, and because it can also be used to measure temperature.

In an alternative embodiment of the heating device 20 that is not shown, a heating conductor coating is, similar to the heating conductor coating 18' shown in FIG. 2, is provided between the heating wire 14 and the coating 22.

Figure 4:
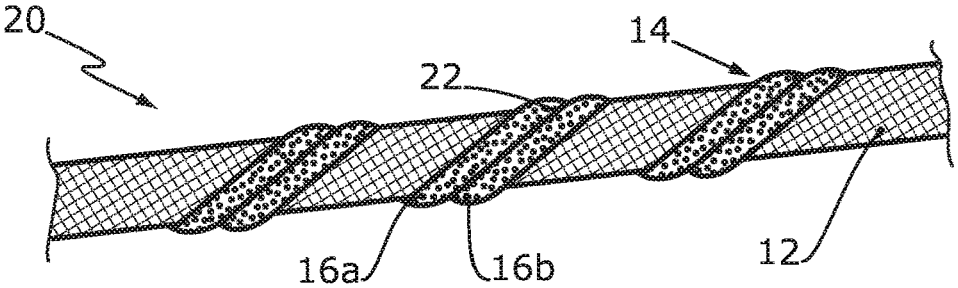
FIG. 4 shows an isometric view of another heating device.

FIG. 4 shows another heating device 20 with a core 12 and a heating wire 14. The heating wire 14 comprises a first heating wire strand 16*a* and a second heating wire strand 16*b*. The heating wire 14 is directly provided with a coating 22, which is thin and flexible, but robust as well. The heating device 20 shown in FIG. 4 that comprises a heating conductor 10 does not have to have any further heating conductor coating.

Figure 5A:
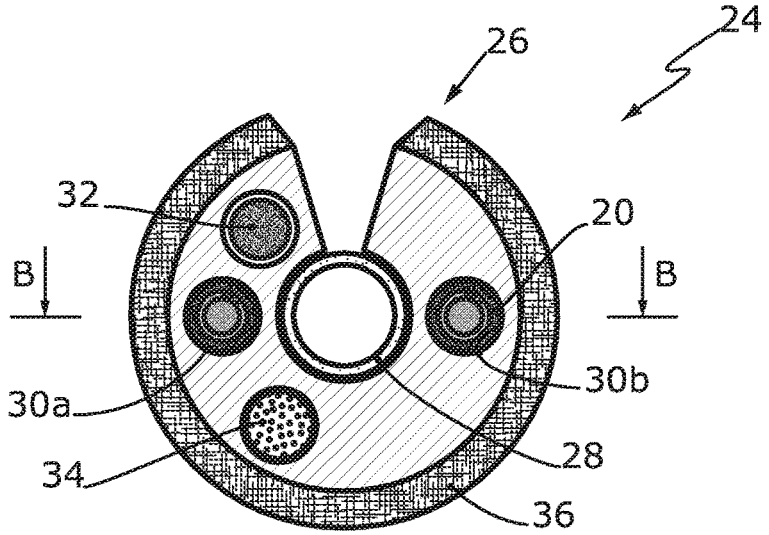
FIG. 5*a* shows a sectional view of a medical device with a heating profile and a heating conductor according to line A-A in FIG. 5*b*.

FIG. 5*a* shows a medical device 24 with a heating profile 26. The heating profile 26 is made from elastic material for receiving a medical instrument 28. The medical instrument 28 may have the form of an infusion line. Formed in the heating profile 26 are a first recessed passage (through bore) 30*a* and a second recessed passage (through bore) 30*b*, in which the heating device 20 according to FIG. 3 or FIG. 4 is arranged. The heating device 20 heats the medical instrument 28.

A reinforcement strand 32 may be arranged in the heating profile 26, at least in sections, in particular only in sections, to protect certain areas against extreme strain (e.g., bending). Alternatively, or additionally, a temperature sensor 34, here in the form of an NTC (negative temperature coefficient) thermistor, may be arranged in the heating profile 26. The medical device may comprise a plurality of temperature sensors.

Figure 5B:
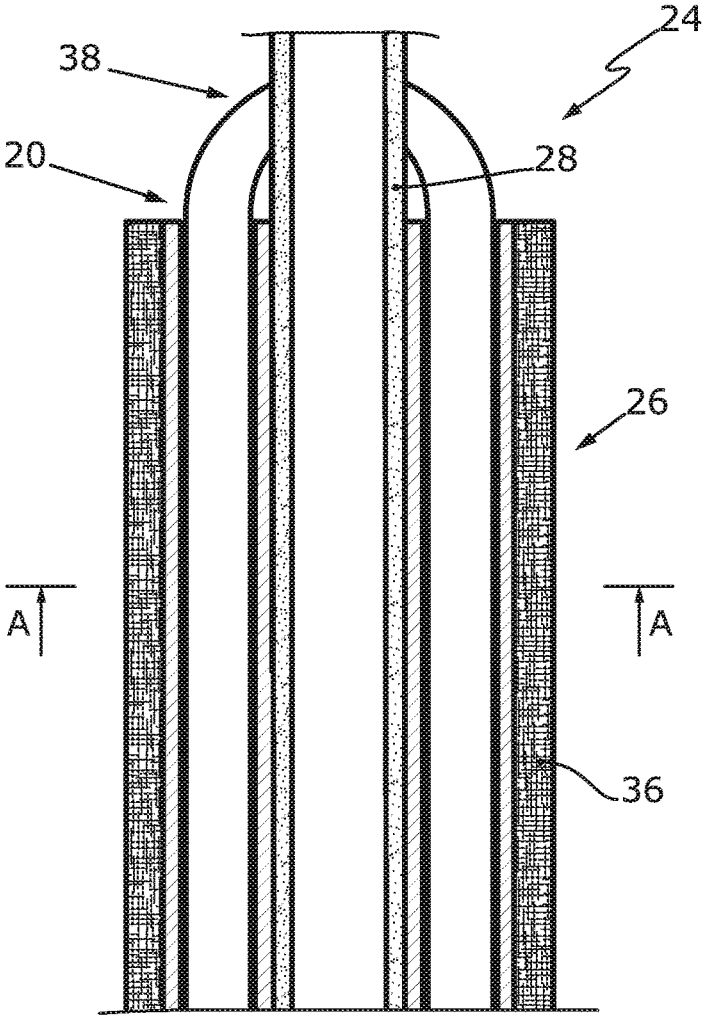
FIG. 5*b* shows a sectional view of the heater conductor from prior art according to line B-B in FIG. 5*a*, whereby the heating conductor is cut.

FIG. 5*b* shows the medical device 24 with the medical instrument 28 in a sectional view. FIG. 5*b* shows that the heating profile 26 has an insulating coating 36 to efficiently heat the heating device 20.

As shown in FIG. 5*b*, the heating device 20 may be mounted in the heating profile 26 in the shape of a U. Alternatively, the heating profile 26 may be formed together with the heating device 20 by coextrusion. After the coextrusion, sections of the heating device 20 may be joined in the area of a bend 38 of the heating device 20, in particular by soldering, welding, or crimping.

Figure 5C:
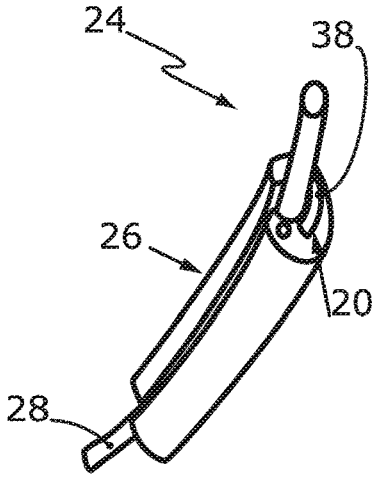
FIG. 5*c* shows an isometric view of the medical device according to FIGS. 5*a* and 5*b*.

FIG. 5*c* shows, for a simple representation, the medical device 24 in a simplified illustration. FIG. 5*c* shows in particular the heating device 20 in the area of the bend 38, the medical instrument 28, as well as the heating profile 26.

Figure 6:
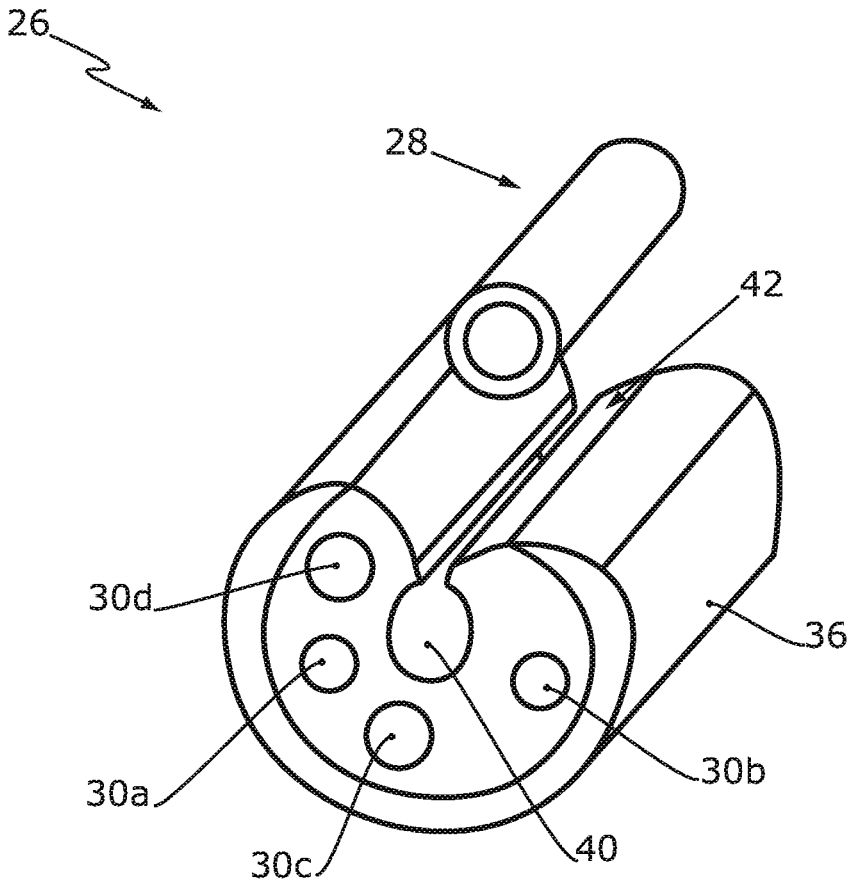
FIG. 6 shows an isometric view of a heating profile.

FIG. 6 shows another embodiment of the heating profile 26 with a medical instrument 28 arranged next to it. A circular notch 40 is formed in the heating profile 26 for receiving the medical instrument 28. The taper 42 of the heating profile 26 facilitates the insertion of the medical instrument 28. Arranged in the heating profile are a first recessed passage 30*a* and a second recessed passage 30*b* as well as a third recessed passage (through bore) 30*c* and a fourth recessed passage (through bore) 30*d*. The third recessed passage 30*c* and the fourth recessed passage 30*d* have a larger diameter than the first recessed passage 30*a* and the second recessed passage 30*b*. The first recessed passage 30*a* and the second recessed passage 30*b* are provided for receiving the heating device 20 (see FIG. 5*a*). The first recessed passage 30*a* is arranged closer to the notch 40 than the second recessed passage 30*b*, which is why the part of the heating device 20 guided through the first recessed passage 30*a* generates a stronger warming of the medical instrument in the notch 40 than the part of the heating device 20 guided through the second recessed passage 30*b*. The third recessed passage 30*c* is therefore arranged closer to the first recessed passage 30*a* than to the second recessed passage 30*b*, because the third recessed passage 30*c* is provided for receiving a temperature sensor 34 (see FIG. 5*a*) to control the temperature of the heating device 20 and of the medical instrument 28, which is intended to protect especially the medical instrument 28 against excessive temperatures.

The fourth recessed passage 30*d* is provided for receiving the reinforcement strand 32 (see FIG. 5*a*).

Figure 7:
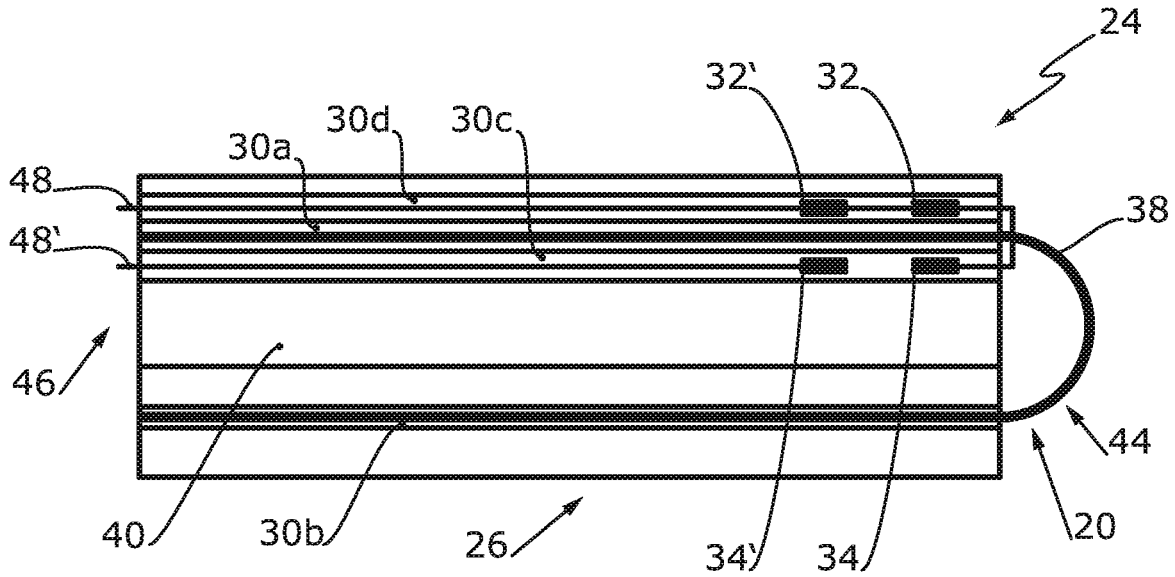
FIG. 7 shows a schematic sectional view of a medical device.

FIG. 7 shows a schematic longitudinal cut through the medical device 24, whereby the cut goes through all four recessed passages (30*a-d*).

At a lengthwise end of the medical device 24, a first temperature sensor 34 is arranged in the third recessed passage 30*c*. This lengthwise end is defined as the outlet side 44 of the medical device 24 according to the flow direction of a liquid in the medical instrument 28 (not shown), which points in the direction of this lengthwise end. The opposite lengthwise end of the medical device 24 is defined as the inlet side 46.

At a close distance from the first temperature sensor 34, a second temperature sensor 34' is arranged in the third recessed passage 30*c*.

Arranged in the fourth recessed passage 30*d* are a first reinforcement strand 32 longitudinally and level with the first temperature sensor 34 and a second reinforcement strand 32' longitudinally and level with the second temperature sensor 34'. The first reinforcement strand 32 and the second reinforcement strand 32' may have the form of a hollow cylinder so that the wire 48 of the first temperature sensor 34 to the outlet side 44 can be led out of the third recessed passage 30*c* and through the fourth recessed passage 30*d* and the first reinforcement strand 32 and the second reinforcement strand 32'. The wire 48' of the second temperature sensor 34' may be led through the third recessed passage 30*c* in the direction of the inlet side 46. This way, the wire 48 of the first temperature sensor 34 and the wire 48' of the second temperature sensor 34' may be led in the direction of the inlet side 46 through the heating profile 26 without additional recesses having to be formed in the heating profile 26. The first temperature sensor 34 and the second temperature sensor 34' may be formed with a greater external diameter than the internal diameter of the third recessed passage 30*c* so that a press fit is created and so that the first temperature sensor 34 and the second temperature sensor 34' are held in their position without any further aids, because no wire 48 has to come into direct contact with the first temperature sensor 34 or the second temperature sensor 34'. Otherwise, the wire 48 could be damaged by the compression.

Figure 8:
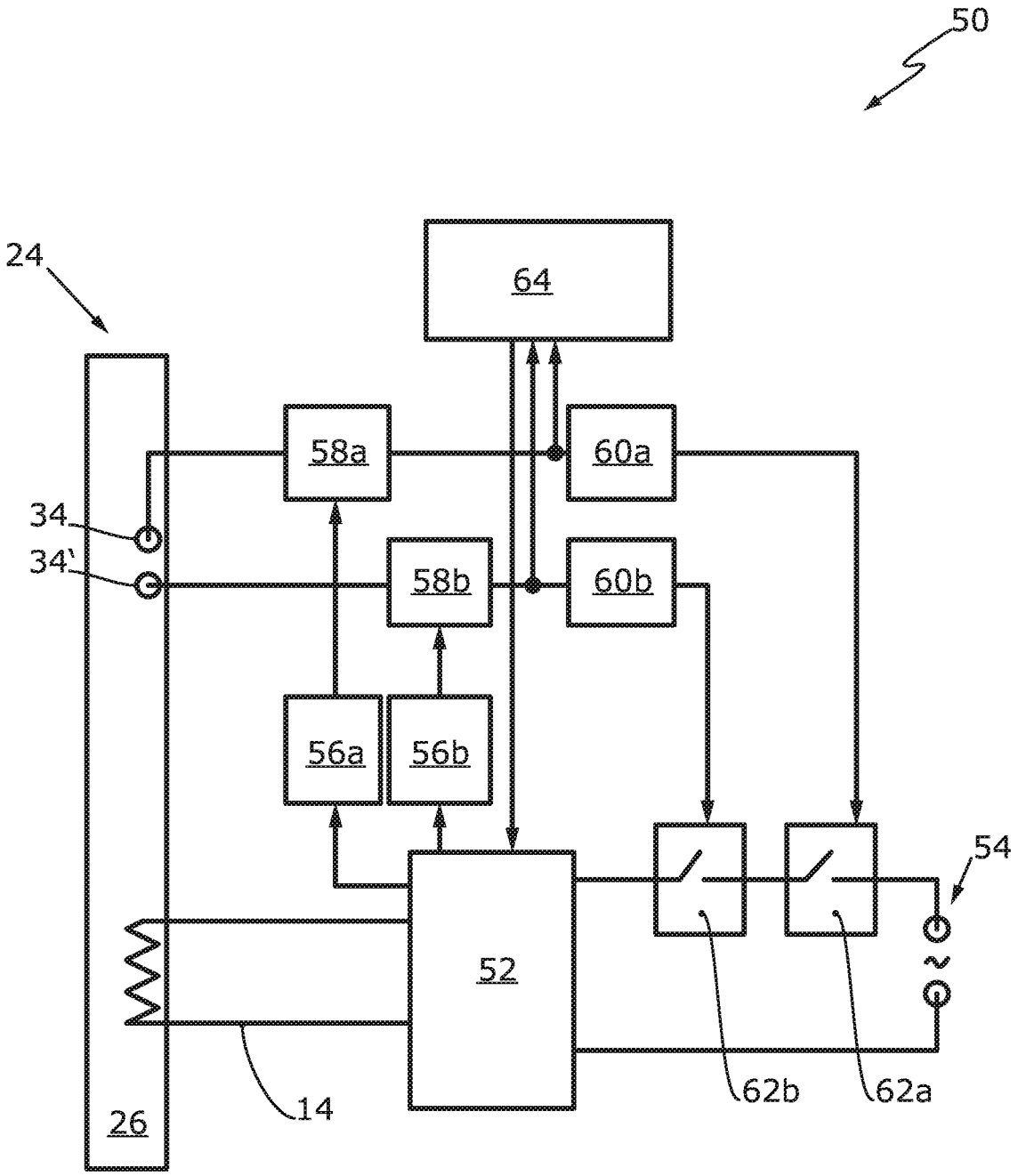
FIG. 8 shows a schematic circuit diagram.

FIG. 8 schematically shows the medical device 24 with an electrical circuit 50. The electrical circuit 50 comprises a control unit 52, which is supplied with energy from a power source 54 and which provides the voltage that is supplied to the heating wire 14. The control unit 52 can determine the temperature from the electrical resistance of the heating wire 14. A first temperature regulator 56*a* and a second temperature regulator 56*b* determine the temperature at the first temperature sensor 34 and at the second temperature sensor 34' by means of a first transducer 58*a* or a second transducer 58*b*. The control unit 52, the first temperature regulator 56*a*, as well as the second temperature regulator 56*b* are interconnected according to a logic and regulate the voltage to supply the heating wire 14. Under normal, correct operation, a lower temperature is determined from the resistance of the heating wire 14 than from the second temperature sensor 34' and a lower temperature is determined from the second temperature 34' than from the first temperature sensor 34. Deviations from this may, depending on the state, allow for the conclusion of wrong operation or a damaged part.

Furthermore, the values from the first transducer 58*a* and the second transducer 58*b* can be compared with a maximum permitted value in a first temperature monitoring 60*a* or a second temperature monitoring 60*b*. If the measured temperature exceeds the maximum permitted value, a first relay 62*a* is opened due to the first temperature monitoring 60*a* or a second relay 62*b* is opened due to the circuit of the energy supply to achieve an immediate shutoff of the heating device 20.

An operation interface 64 may furthermore display the temperatures and any errors detected.

Taking all figures in the drawings into consideration, the invention relates to a heating device 20 comprising a heating wire 14, which is made from material that has a positive electrical resistance gradient when the temperature increases. This prevents the heating wire 14 from overheating. Furthermore, the gradient makes it possible to determine the temperature of the heating wire 14. The heating wire 14 may, at least in sections, be surrounded, either indirectly and/or directly, with a coating 22. The coating 22 is, in particular, arranged or formed so that it protects the heating wire 14 against corrosive disinfectants. The heating wire 14 may be wound around a core 12. The heating wire 14 may form a heating conductor 10 together with the core 12. The heating conductor 10 may form a heating device 20 together with the coating 22. The heating conductor 10 may be inserted into a heating profile 26. The heating profile 26 serves here as a support structure for the heating conductor 10. The heating device 20 may be arranged in a medical device 24 in which a medical instrument 28 is arranged. Temperature sensors 34 and reinforcement strands 32 may be arranged in the medical device 24. The medical device 24 may comprise an electrical circuit 50 that serves to monitor the medical device 24 and regulate the heating wire 14.

List of Reference Numerals:

10, 10' Heating conductor
12, 12' Core
14, 14' Heating wire
16*a*, 16*a'* First heating wire strand
16*b*, 16*b'* Second heating wire strand
18' Heating conductor coating
20 Heating device
22 Coating
24 Medical device
26 Heating profile
28 Medical instrument
30*a* First recessed passage (through bore)
30*b* Second recessed passage (through bore)
32, 32' Reinforcement strand
34, 34' Temperature sensor
36 Insulating coating
38 Bend
40 Circular groove
42 Taper
44 Outlet side
46 Inlet side
48 Wire
50 Electrical circuit
52 Control unit
54 Energy source
56*a* First temperature regulator
56*b* Second temperature regulator
58*a* First transducer
58*b* Second transducer
60*a* First temperature monitoring
60*b* Second temperature monitoring
62*a* First relay
62*b* Second relay
64 Operation interface
$D_{H1}'$, $D_{H2}'$, $D_{H2}$ Diameter of the heating conductor 10, 10' or the heating device 20
$D_B$ Thickness of the coating 22

What is claimed is:

1. A medical device with a heating device for a medical instrument, the heating device comprising:

a heating wire, wherein the heating wire consists of a metal alloy that has in the temperature range between 0° C. and 100° C. a temperature-sensitive electrical resistance gradient of at least 0.004Ω/(m*K);

wherein the medical device comprises a heating profile and wherein the heating profile comprises a first recessed passage arranged parallel to the central longitudinal axis of the heating profile in which the heating wire is arranged; and an electrical circuit arranged indirectly or directly on the heating device for determining the electrical resistance of the heating wire and/or the current that flows through the heating wire;

wherein the heating profile comprises a second recessed passage that extends parallel to the central longitudinal axis of the heating profile in which a temperature sensor is arranged;

wherein the electrical circuit is designed to interrupt the current that flows through the heating wire when the average temperature of the heating wire determined from the electrical resistance of the heating wire and/or from the current that flows through the heating wire and the temperature measured by the temperature sensor deviates by a preset value.

2. The medical device according to claim 1, wherein the heating wire is made from a nickel alloy, in particular with a purity degree of at least 99.6% nickel.

3. The medical device according to claim 1, wherein the heating wire comprises a first heating wire strand and at least one second heating wire strand.

4. The medical device according to claim 1, wherein the heating device comprises a heating conductor with a core, especially in the form of an aramid-containing core, and wherein the heating wire is wound around the core.

5. The medical device according to claim 4, wherein the heating conductor comprises a heating conductor coating and wherein the heating wire coating contains silicone, polyurethane, polyvinyl chloride, fluoride-containing polymer, and/or imide-containing polymer.

6. The medical device according to claim 1, wherein the temperature sensor is arranged close to the lengthwise end of the heating profile.

7. The medical device according to claim 6, wherein a second temperature sensor is arranged in the second recessed passage close to the lengthwise end of the heating profile and at a distance from the first temperature sensor.

8. The medical device according to claim 1, wherein the heating profile comprises a third recessed passage that extends parallel to the central longitudinal axis of the heating profile in which the heating wire is arranged.

9. The medical device according to claim 1, wherein the heating wire is arranged by coextrusion in the heating profile.

10. The medical device according to claim 1, wherein the medical device has an insulating coating at the heating profile which is made from heat-insulating material.

11. The medical device according to claim 1, including a medical instrument arranged indirectly or directly on the heating device, wherein the medical instrument is formed in particular in the form of an infusion tube.

* * * * *